United States Patent [19]

Magill

[11] Patent Number: 4,921,070

[45] Date of Patent: May 1, 1990

[54] TEMPORARY SUSPENDED ACCESS EQUIPMENT - A BUILDER'S CRADLE

[76] Inventor: Alan R. Magill, 77/79 Euston Street, London NW1 2ET, England

[21] Appl. No.: 293,277

[22] Filed: Jan. 4, 1989

[51] Int. Cl.[5] ..... E04G 3/10

[52] U.S. Cl. ..... 182/142; 182/82; 182/38; 182/150

[58] Field of Search ..... 182/142, 143, 144, 82, 182/36, 37, 38, 12, 13, 14, 150

[56] References Cited

U.S. PATENT DOCUMENTS

| | | | |
|---|---|---|---|
| 306,526 | 10/1884 | Rossvally | 182/37 |
| 323,152 | 7/1885 | Howes | 182/37 |
| 536,232 | 3/1895 | Potts | 182/36 |
| 911,919 | 2/1909 | Thompson | 182/37 |
| 1,642,333 | 9/1927 | Damore | 182/142 |
| 2,814,533 | 11/1957 | Van Horn | 182/142 |
| 2,881,029 | 4/1959 | Tollefsen | 182/142 |
| 3,220,509 | 11/1965 | Fisher | 182/142 |
| 3,661,226 | 5/1972 | Fisher | 182/142 |
| 4,424,884 | 1/1984 | Smith | 182/142 |

*Primary Examiner*—Reinaldo P. Machado
*Attorney, Agent, or Firm*—Spencer & Frank

[57] ABSTRACT

A work cradle comprising a work platform suspended by ropes from a building. Two guide ropes extend downwardly on either side of the platform and are secured to the building. The work platform is attached to the guide ropes by two further ropes which are slidable along the guide ropes by means of releasable hooks. The ropes pass over respective pulleys attached to an extension projecting from the platform in a direction away from the building. A winch is provided for each rope to apply tension to the ropes by means of which the platform may be prevented from swinging away from the building, and/or may be moved to a different lateral position, at a given suspension height.

Also disclosed is a beam clamp which may be used with the above-described work cradle.

12 Claims, 8 Drawing Sheets

TEMPORARY SUSPENDED ACCESS EQUIPMENT - A BUILDER'S CRADLE

BACKGROUND OF THE INVENTION

This invention relates to builders' cradles. These are used to gain access to buildings for the purpose of exterior maintenance.

Traditional builders' cradles are suspended by wires or ropes from a carriage on a rail attached to the top of a building. They are awkward to work from because they swing away from the building, (unless the cradle is the permanently fixed type with fixed vertical rails).

One known cradle is disclosed in U.S. Pat. No. 3,661,226 (Fisher), and comprises a suspended working platform which is movable up and down the side of an object to be welded by means of winches which can reel in or pay out cables by means of which the platform is suspended. The cradle is provided with guide wheels which engage with guide tracks on the object to be welded to keep the cradle moving in a straight line. The cradle is provided with two pulley wheels mounted on a horizontal axis, which are outwardly spring-loaded. Cables attached to the top and to the bottom of the object to be welded pass over a respective one of the pulleys, and are held taut by the spring-loading thereof, which therefore urge the cradle towards the object to be welded and keep it in contact therewith.

However, the use of guide wheels and the necessity for guide tracks limit the applicability of this known device. In particular, it would be very difficult to adapt the known device for use as a temporary cradle which might be necessary, for example, when restoration work is being carried out on a building. The prior art device is more suited to applications wherein the cradle is repeatedly used on the same structure, where guide tracks were provided. In the absence of guide tracks, although the cradle would still be biassed towards the object, there is nothing to prevent the cradle from moving horizontally except the vertical wires which would tend to flex. This might make the cradle difficult and/or dangerous to use on a structure which is not specifically adapted to work with the cradle, especially, for example, on a building in high winds. Additionally, there are no means for moving the cradle from side to side, only means for moving it up and down along the length of the guide tracks.

OBJECT OF THE INVENTION

It is an object of the present invention to provide a support system for a workman, which may be used temporarily on a building or other structure, which biasses a work platform towards the building or other structure, which locates the work platform on the building or other structure, and which may be moved from side to side.

SUMMARY OF THE INVENTION

In accordance with the present invention, there is provided a workman support system for working on a building or other structure, comprising a cradle having a platform adapted, in use, to be suspended from the structure, two elongate guide means positioned on opposite sides of the platform and, in use, extending downwardly from the structure, each guide means being provided with a rope, cable or other elongate flexible member coupled thereto and movable therealong and also coupled to the platform, and tensioning means for applying tension to the elongate flexible members, whereby, in use, to exert a lateral force on the platform towards the structure.

This provides a tensioning system which provides similar mechanical purchase for temporary cradles as that provided for permanent cradles. It is intended that these cradles stall be available to hire to the building maintenance industry as an alternative to scaffolding.

In a preferred embodiment, the tensioning system comprises two vertical wires attached by removable anchor-eyebolts to the far corners of the building, (assuming the building is roughly rectangular). These wires are made tight by such means as a bottle screw. They will provide the function of fixed vertical rails. To the vertical wires are attached by means of releasable hooks two horizontal wires. These horizontal wires are attached at the other end to two winches mounted in the centre of the builder's cradle.

When both winches are wound in the wires will become taut and the cradle, sandwiched between the taut wires and the building will be propelled by the 'bow spring effect' towards the building. This effect is enhanced by increasing the angle (x) between the wall and the cradle wire as indicated in FIG. 8.

This is achieved by running each horizontal wire (h) through pulleys mounted on an apendage protruding from the side of the cradle. In the preferred embodiment this appendage is a demountable 'D'-shaped member slotted into the floor of the cradle.

The same tensioning system as described above also moves the cradle from one side of the building to the other. When one winch is selected to run free and the other is wound in the cradle will move in one direction and the reverse procedure will move it in the other direction.

The same 'bow-spring' and lateral movement effects could be achieved with soft ropes instead of wires and a simple deck cleat and more human effort could replace the winches and this might be a less expensive means of achieving the same ends.

Also one continuous wire or rope could be used instead of the two separate horizontal wires described herein but the winches would have to be designed specially to run both ways, be equipped with a tensioning device to keep the wire tight against both drums and it would be more complicated to use the winch drums to store the wire when the cradle is not in use as is the case with twin wire system.

There may also be provided a novel attachment and clamp which secures the 'I' beam from which the cradle is hung, to the roof above. There are two clamps, one for either end of the 'I' beam. Each clamp captures the beam inside it, like an internal rail. A pressure applying device, such as a thumb screw can be applied to secure the clamp in palace on the 'I' beam or loosened to allow the clamp to be slid to a more convenient position.

The clamp accommodates a 'D' ring or shackle to which a rope may be fastened and this rope is attached at the other end to a strong point on the roof. In the absence of strong points the rope may be attached to a ballast bag on the other side of the building. This balast bag is filled with a cellular material that absorbs water slowly. The water is used as ballast and in the event of a leak the leak will be slow. As a safety measure the bag is placed upon electric scales which set off an alarm should the weight of the ballast decrease to a dangerous level.

The above mentioned clamp is provided with a socket to which variable length fenders may be attached at a right angle to it. These hold the beam the correct distance away from the wall to avoid projections such as the eaves, abuttments and overhanging coping.

The clamp herein described provides the dual functions of a positioning and attaching device for the supporting beam and additionally it can be positioned at any convenient place along the beam.

A better understanding of the invention and its advantages can be gained from the following description of the preferred embodiment with reference to the accompanying drawings.

DESCRIPTION OF THE PREFERRED EMBODIMENT

FIG. 1

Figure 1:
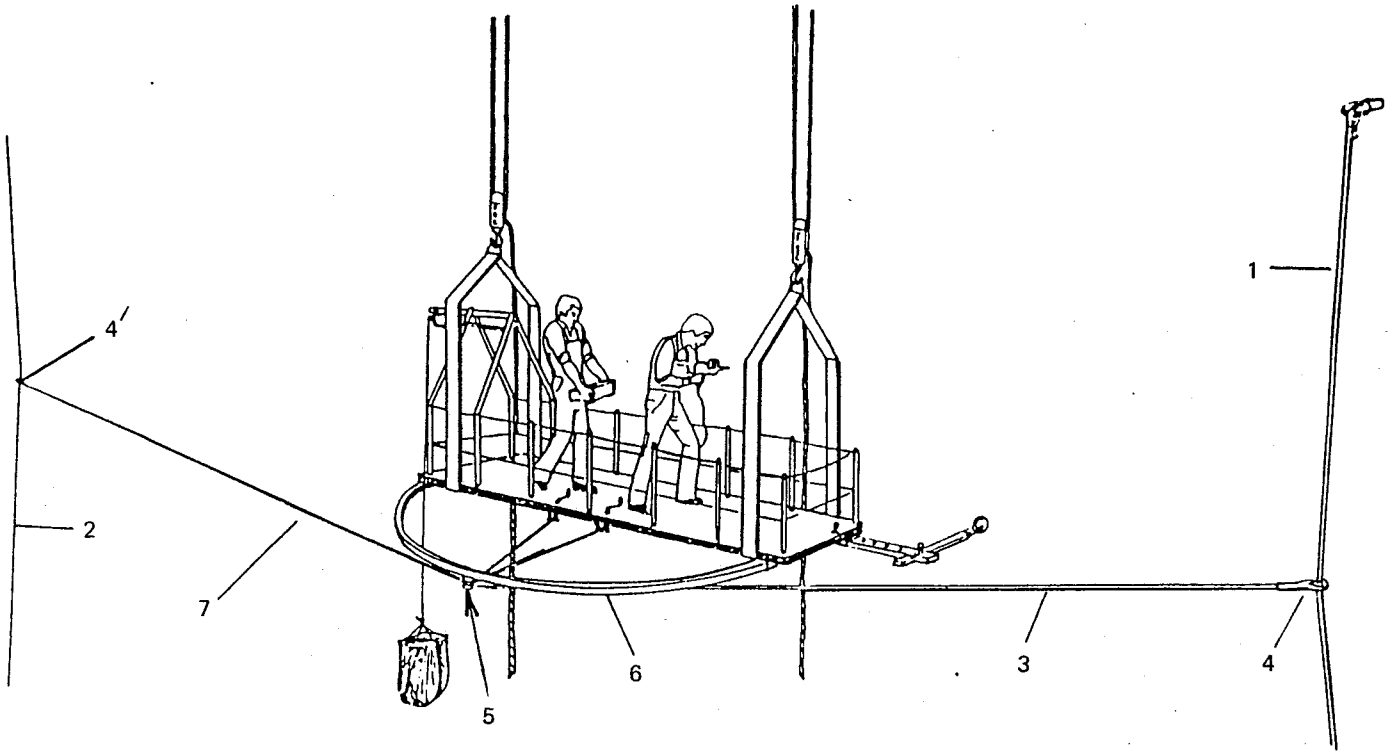
FIG. 1 A three-dimensional representation.
Figure 2:
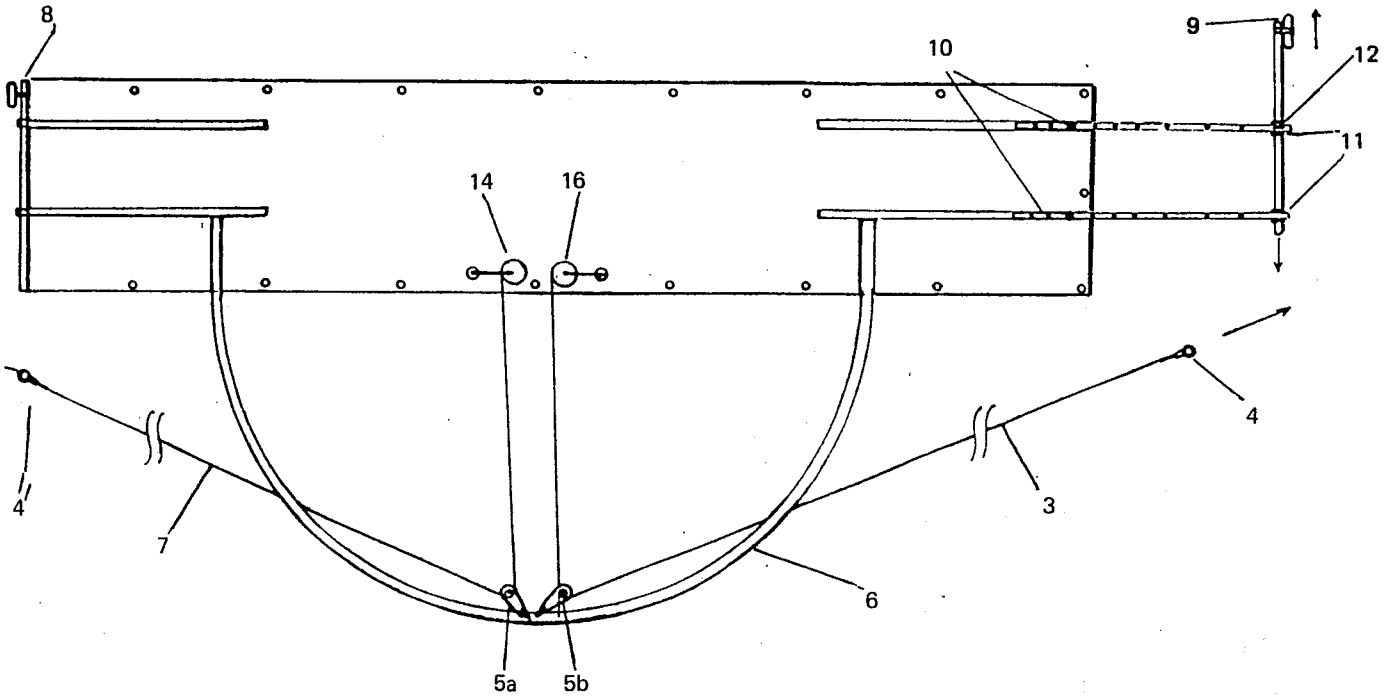
FIG. 2 Plan of the cradle platform.
Figure 3:
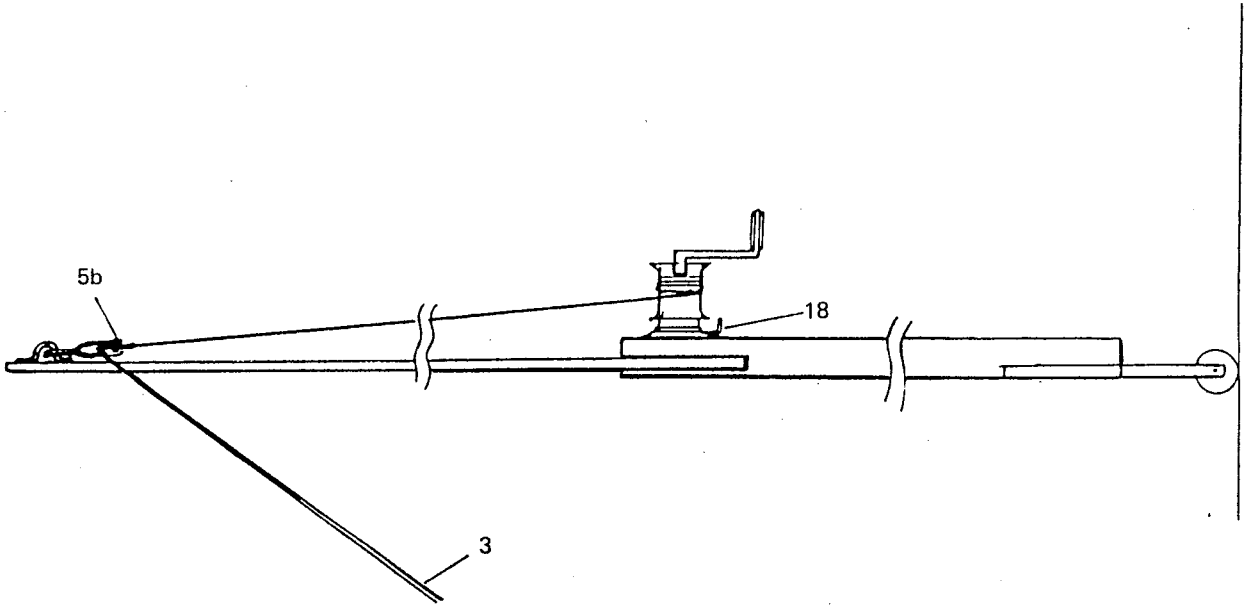
FIG. 3 Cross-section of the tensioning system.
Figure 4:
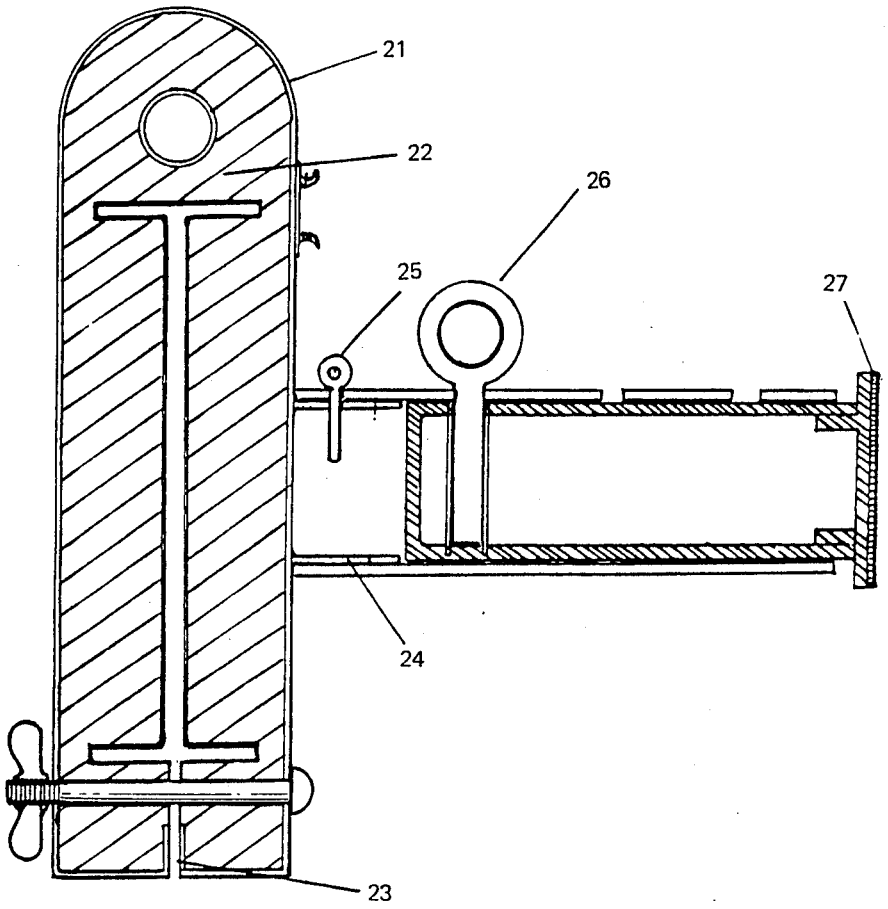
FIG. 4 Cross-section of a beam clamp.
Figure 5A:
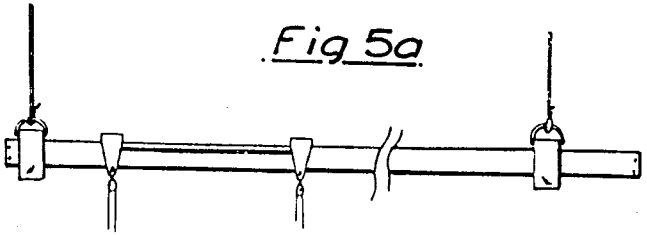
FIG. 5*a* Beam, clamp and cradle runner assembly.
Figure 5B:
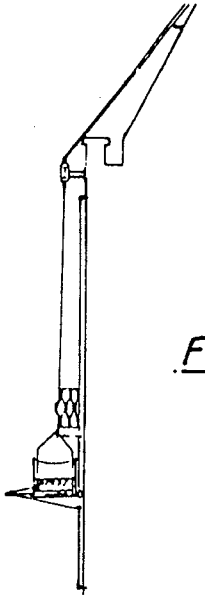
FIG. 5*b* Beam clamp and fender in use.
Figure 5:
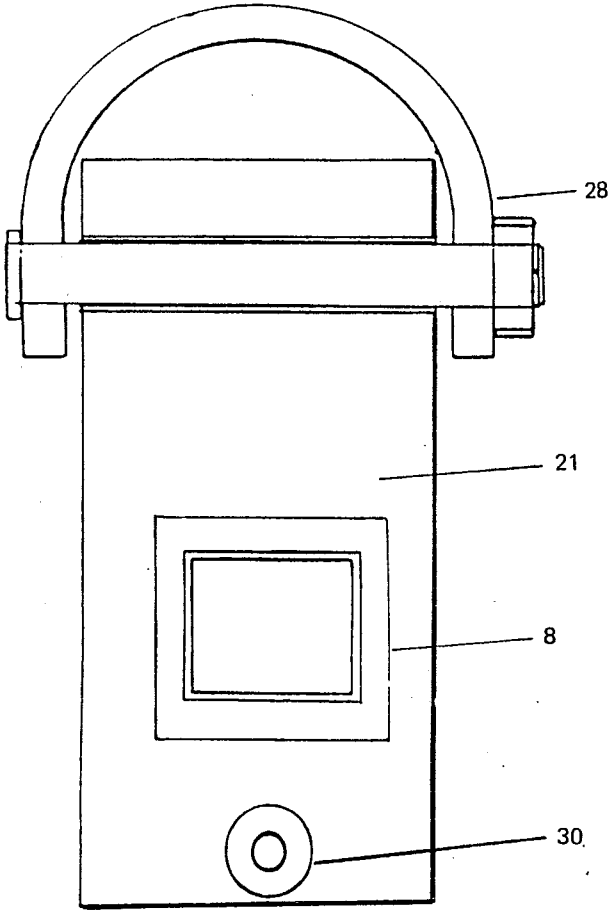
FIG. 5 Cross-section of a beam clamp (90° rotated).
Figure 6:
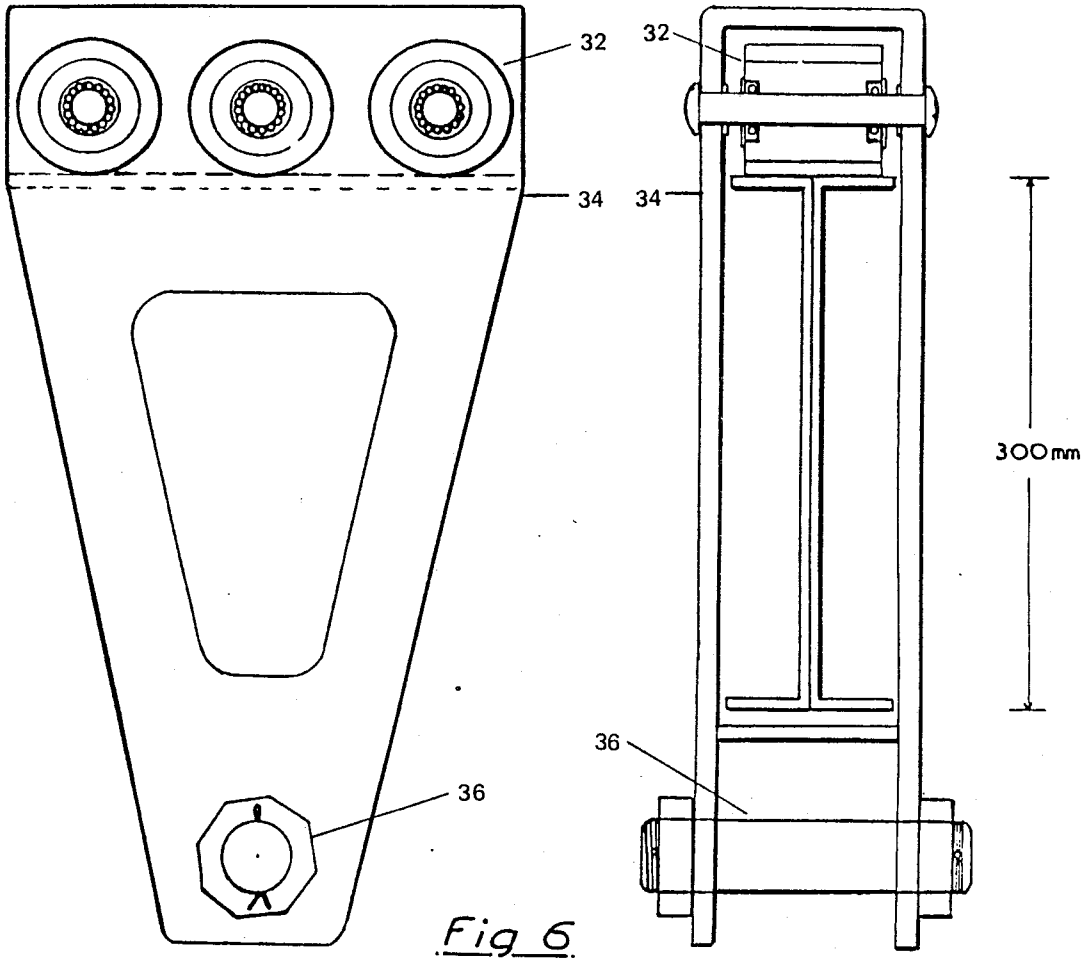
FIG. 6 Cross-sections of cradle runners.
Figure 7:
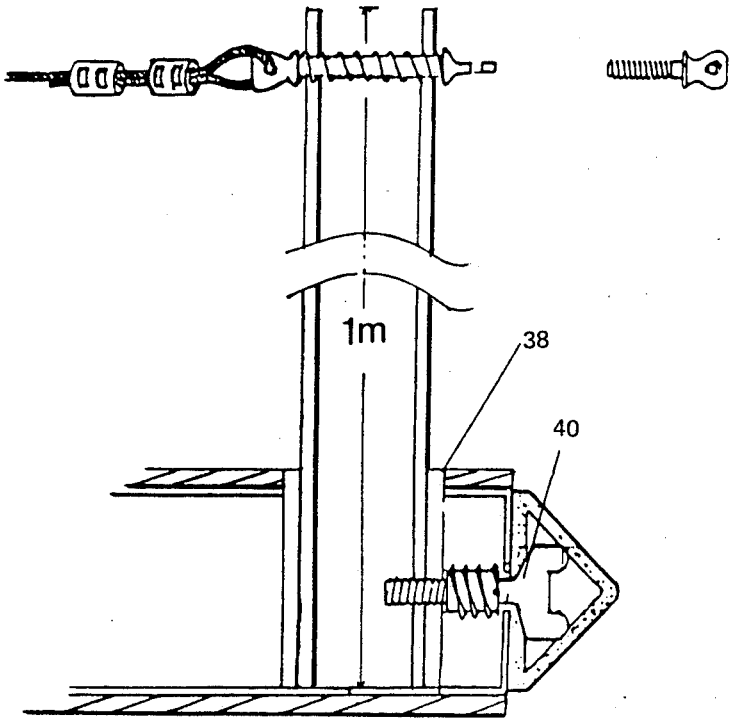
FIG. 7 Cross section of cradle platform and a Stanchion (hand rail).
Figure 8:
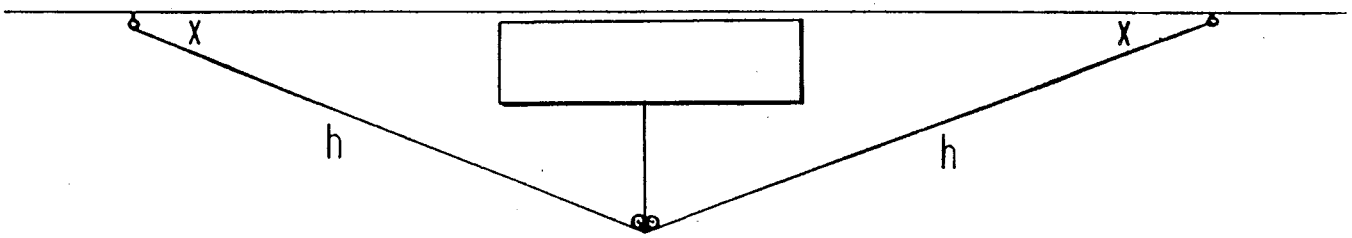
FIG. 8 Schematic plan view of the FIG. 1 arrangement.

A three-dimensional representation. Two men are shown working on a 4 m×1 m cradle. A vertical wire 1, is secured top and bottom to the wall by removable anchor eyebolts. The wire is hooked on to the eye bolts and tightened by a bottle screw or other wire tightening device. A similar wire 2 is shown on the other side of the building. A horizontal wire 3 is fixed to the vertical wire by means of a releasable hook 4, so that it may slide up and down the vertical wire. The same is repeated on the other side. The horizontal wire is fed through a pulley 5, mounted on an apendage 6, and secured to a winch. The same is repeated for the other horizontal wire 7. In this preferred embodiment the apendage is a 'D'-shaped pultruded glass fiber square tube slotted into sockets in the cradle platform.

FIG. 2

Plan of the cradle platform. Illustrates the position of winches 14 and 16, and pulleys 5*a* and 5*b*. It can be seen that when the wires are secured by their detachable hooks 4 and 4' to the vertical wires (not shown) and wound in by the winches they will become tight. To move the cradle to the left (looking down the plan) winch 16 is selected to run free, and winch 14 is wound clockwise. The cradle will move to the left. (It is suspended from above on wheeled runners like a traditional cradle). The opposite procedure will move the cradle to the right.

The 'D'-shaped member 6 is of a springy nature and may be constructed from pultruded glass fibre square tube. The energy produced when bending it to fit into the accommodating slots serves to provide the friction necessary between slot and tube to keep it in place. This facilitates easy assembly.

Also featured in this illustration are the adjustable and wheeled fenders 8 and 9. These also slot into the platform and may be moved in and out. A peg-and-hole system 10 will secure them. The arm upon which the wheel is fixed is also adjustable. It is secured by a sliding and locking device 11, allowing movement in the direction of the arrows and may be fixed by means of a thumb screw 12. The purpose of this adjustability is to enable the cradle to be conveniently distanced from the wall as required by specific maintenance jobs, (such as when working on the underside of the balcony). The lengthwise-adjustment allows the wheels to be positioned so as to avoid damage to windows.

FIG. 3

Cross-section of one side of the tensioning system. The wire rope 3 is fed through a pulley 5*b*, and secured in a winch large enough to accommodate all or part of the wire. A ratchet on the winch holds the tension until it is released by action upon a lever 18. A slight improvement on this basic system would be to have the winch drum and the pulley mounted on the underside of the platform and the 'D'-shaped member, (or similar apendage). The winch activating means would remain on the top side. By this means tensioning wires in relation to the attitude of the platform would be parallel and the slight turning moment in the previous and simpler design would be avoided.

FIG. 4

Cross-section of the Beam Clamp. The 'I' beam upon which this clamp is secured runs through the centre of it and can be seen by the 'I'-shaped profile. The outer skin of the clamp 21 is made of a durable material such as stainless steel. The inner filling of the clamp is of a rubber-like material and this is illustrated by the cross-hatching, 22. A slot is cut in the bottom of the clamp 23, and passing through it is a bolt and a thumbscrew or other tightening device. The thumbscrew is slackened off to slide the clamp to a convenient position on the beam and tightened to secure it. A reinforced hole running through the top of the clamp accepts a 'D' ring or similar shackle to which a rope may be fastened. This rope may be fastened to a strong point on the roof such as a large chimney stack or to a ballast bag on the other side of the building. A socket 24 protrudes at a right angle from the clamp to accommodate an extensible member which may be fixed by peg 25. This member is adjustable longitudinally by a catchment means such as a peg and hole means, 26. The member has a rubber-like fender pad at the end 27. The purpose of this member is to act as a positioning device to keep the beam the correct distance from the wall as described previously.

FIG. 5

Cross-section of the beam clamp. This is another view of the beam clamp observed 90° from the previous cross-section. It shows the durable outer skin 21, the end-view of the fender 8, the shackle 28 and the dome-head end of the thumbscrew.

FIG. 5*a*

Beam, clamp and cradle runner assembly. This shows two clamps and two cradle runners mounted on an 'I' beam.

FIG. 5*b*

This illustrates the beam-clamp-and-fender in use.

FIG. 6

Cross-section of cradle runners. These runners comprise wheels 32, fixed in a housing 34, and provided with a fixing 36, which will accept the hook of a block and tackle from which the cradle will be suspended and adjusted vertically. The unit runs along the top face of the 'I' beam. In the preferred embodiment the 'I' beam and wheels are made from reinforced glass fibre and tufnol, respectively.

FIG. 7

Cross-section of cradle platform and a stanchion (hand rail). This illustrates how the body of the platform is used to accept a socket 38 and threaded key 40, or other locking device, to secure and hold down a hand rail slotted into the socket. A few turns on the key will loosen and free the hand rail to facilitate stowage.

I claim:

1. A workman support system for working on a building or other structure, comprising:

a cradle;

a platform forming part of said cradle, and being adapted, in use, to be suspended from said building or other structure;

two elongate guide means positioned on opposite sides of said platform and, in use, extending downwardly from said building or other structure;

a respective rope, cable or other elongate flexible member coupled to, and movable along, each of said elongate guide means, and also coupled to said platform; and tensioning means for applying tension to said ropes, cables or other elongate flexible members to exert a lateral force on the platform towards said building or other structure from which said platform is suspended.

2. A workman support system as claimed in claim 1, wherein each of said elongate flexible members is provided with its own tensioning means.

3. A workman support system as claimed in claim 1, wherein said elongate guide member also comprises a rope, cable or other elongate flexible member.

4. A workman support system as claimed in claim 1, further comprising an extension projecting away from said cradle, around which said flexible member forming part of said tensioning means is entrained, thereby permitting an increase in the lateral force exerted on the platform towards said building or other structure.

5. A workman support system as claimed in claim 4, comprising a pulley on said extension, around which pulley said elongate flexible member is entrained.

6. A workman support system as claimed in claim 4, wherein said extension comprises a resiliently deformable member deformed into an arcuate shape and attached to said platform.

7. A workman support system as claimed in claim 1, wherein the work platform is provided with abutment means adapted, in use, to abut the structure.

8. A workman support system as claimed in claim 1, further comprising a beam-clamping device, the beam clamping device comprising:

a support body, at least a portion of which is resiliently deformable;

a beam-receiving aperture in said resiliently deformable portion, shaped to slidably receive a suspension beam from which said platform is, in use, suspended; and securing means for securing said beam clamping device at a position along said suspension beam.

9. A workman support system as claimed in claim 8, further comprising a relatively rigid outer casing enclosing said resiliently deformable portion of said support body.

10. A workman support system as claimed in claim 9, wherein said securing means comprises two portions of said casing situated on opposite sides of the beamreceiving aperture, and means for reversibly displacing said portions towards each other.

11. A workman support system as claimed in claim 8, wherein the beam-clamping device comprises means for attachment to a rope, cable or other elongate flexible suspension means.

12. A workman support system for working on a building or other structure, comprising:

a cradle;

a platform forming part of said cradle;

a suspension rope or cable connected to said cradle, for suspending the cradle from said building or other structure;

two guide ropes or cables positioned on opposite sides of said platform and, in use, suspended from said building or other structure;

a respective further rope or cable slidably disposed along each of said guide ropes or cables and also coupled to said platform; and winch means located on said platform for applying tension to said further ropes or cables to exert a lateral force on said platform towards said building or other structure from which said platform is suspended.

* * * * *